United States Patent [19]

Brant

[11] Patent Number: 5,067,675

[45] Date of Patent: Nov. 26, 1991

[54] FASCIA ANGLE ADAPTER FOR AN EAVESTROUGH SYSTEM

[75] Inventor: Anthony W. Brant, Minesing, Canada

[73] Assignee: GSW Inc., Canada

[21] Appl. No.: 565,970

[22] Filed: Aug. 13, 1990

[51] Int. Cl.[5] ..... E04D 13/06

[52] U.S. Cl. ..... 248/48.2; 52/11; 52/94

[58] Field of Search ..... 248/48.1, 48.2; 52/11, 52/12, 94

[56] References Cited

U.S. PATENT DOCUMENTS

| | | | |
|---|---|---|---|
| 2,024,348 | 12/1935 | Feltman | 248/48.2 |
| 4,432,518 | 2/1984 | Navarre | 248/48.2 |
| 4,956,950 | 9/1990 | Hirose | 52/11 |

*Primary Examiner*—John E. Murtagh

[57] ABSTRACT

The present invention relates to a fascia angle adapter for an eavestroughing system wherein the fascia angle adapter allows for supporting of an eavestrough hanger or other support fitting at different angles relative to a fascia board. The adapter is placed intermediate the hanger and the fascia board. The adapter has a base member having a fascia engaging surface, a top port for securing of the adapter to a fascia board, and an eccentric cam supported by the base member and movable with respect thereto whereby the cam can be moved to various positions such that the exterior surface of the cam is spaced a different distance from the fascia engaging surface. The cam member is preferably rotatably supported within the base member and has a number of planar surfaces about the periphery of the cam for defining, in cooperation with the base member, predetermined angles for known angled fascia. This arrangement provides a simple solution whereby the installer can easily adjust the angle of the eavestrough hook for optimum utility.

20 Claims, 4 Drawing Sheets

FASCIA ANGLE ADAPTER FOR AN EAVESTROUGH SYSTEM

FIELD OF THE INVENTION

The present invention relates to a fascia angle adapter for an eavestrough system. In particular, the invention relates to a fascia angle adapter having a movable member which can be adjusted to various positions to appropriately position an eavestrough hanger.

BACKGROUND OF THE INVENTION

In the installation of an eavestrough system, it is important that the eavestrough be secured in a manner such that it is generally horizontal, whereby the full capacity of the eavestrough can be realized. In some home construction, the fascia board is mounted perpendicular to the slope of the roof and thus, the angle of the slope of the roof must be corrected when eavestrough hangers are mounted to the fascia board. Spacers have been used in the past for appropriately spacing the eavestrough hanger from the fascia board and other more complicated ratchet type arrangements have been used for securing of the eavestrough hook at the appropriate angle from the fascia board.

There remains a need to provide a simple mechanism which can easily be mounted and cooperates with the eavestrough hanger for ease of installation while accommodating various angled fascia boards.

SUMMARY OF THE INVENTION

A fascia angle adapter, according to the present invention, comprises a base member having a fascia engaging surface, a top port for securing of the adapter to the fascia board, and an eccentric cam supported by said base member and movable with respect thereto whereby the cam can be moved to various positions, such that the exterior surface of the cam is movable to various positions varying the distance between the exterior surface of the cam and the fascia engaging surface. This structure allows an eavestrough hanger to be supported by the fascia angle adapter at various positions by merely adjusting of the cam member to the appropriate position. Thus, the one adapter is suitable for roof slopes of different angles, allowing ease of stock keeping and ease of use by the end user.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
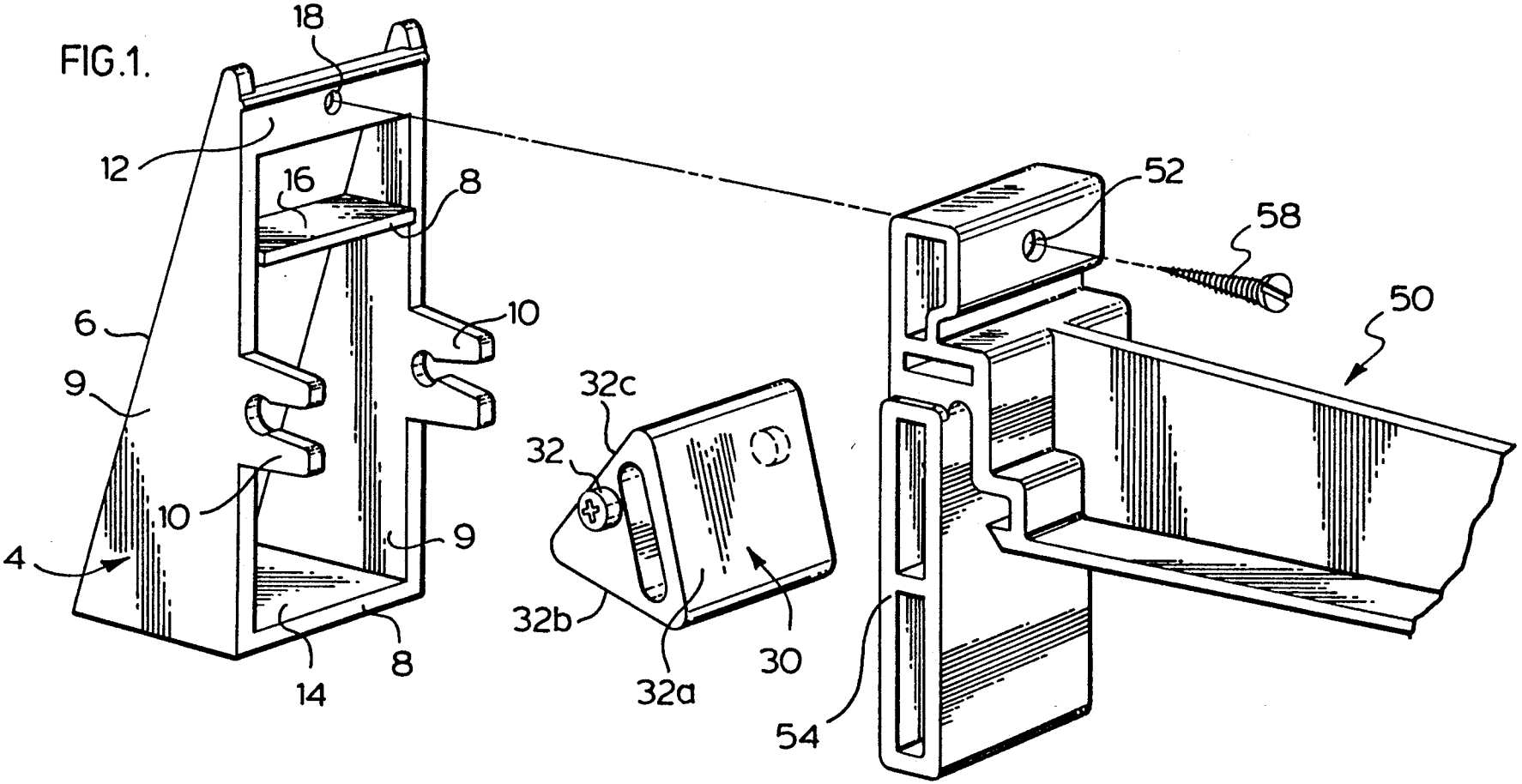
FIG. 1 is an exploded perspective view of the fascia angle adapter and an associated eavestrough hanger.

The fascia angle adapter 2 shown in FIG. 1 is designed for supporting the eavestrough hanger 50 at predetermined angles. The fascia angle adapter is for use where the fascia board is not vertical, but is perpendicular to the roof slope or at some other angle relative to the roof slope requiring correction. In order to satisfactorily install the eavestrough system, the eavestrough should be generally horizontal and thus, a correction must be made for proper positioning of the eavestrough hanger. The fascia angle adapter 2 has a base member 4 with a fascia engaging surface 6. The base 4 also includes a second surface collectively defined by the surfaces identified as 8 in FIG. 1 for supporting of a mounting base, if required. This would be the case where the eccentric cam, generally shown as 30, is not used and the support member of the eavestrough hanger is braced by second surface 8. When the eccentric cam is inserted in the base member 4, the eavestrough hanger 50 is supported adjacent the top mount port 18 and by one of the planar surfaces 32*a* through 32*c* of the eccentric cam shown in FIG. 1. The particular planar surface that is used will depend upon the angular position of the eccentric cam 30.

The base member 4 has side sections 9 which include bifurcated arms 10 for engaging the cam pins 34 provided either side of the eccentric cam 30. The base member 4 also includes a bridging member 12 provided adjacent the top of the base member 4, an intermediate strut 16 extending horizontally between the side sections 9, and a bottom member 14 essentially defining a rectangular like framework. The base member 4 has an overall wedge type shape, as the support surface 8 and the fascia engaging surface 6 are angled to define such a wedge configuration. The rear and front of the base member are generally open.

The eccentric cam 30, in this case, is of a three lobe type configuration and the surfaces of the lobe 32*a* through 32*c* are spaced different perpendicular distances from the cam pins 34.

To assist the end user in accurately positioning of the eavestrough hanger 50 or other support fitting, the cam pins on the flat surface thereof can include a recess, in this case in the form of a cross, to allow adjustment by means of a Phillips screwdriver.

Figure 2:
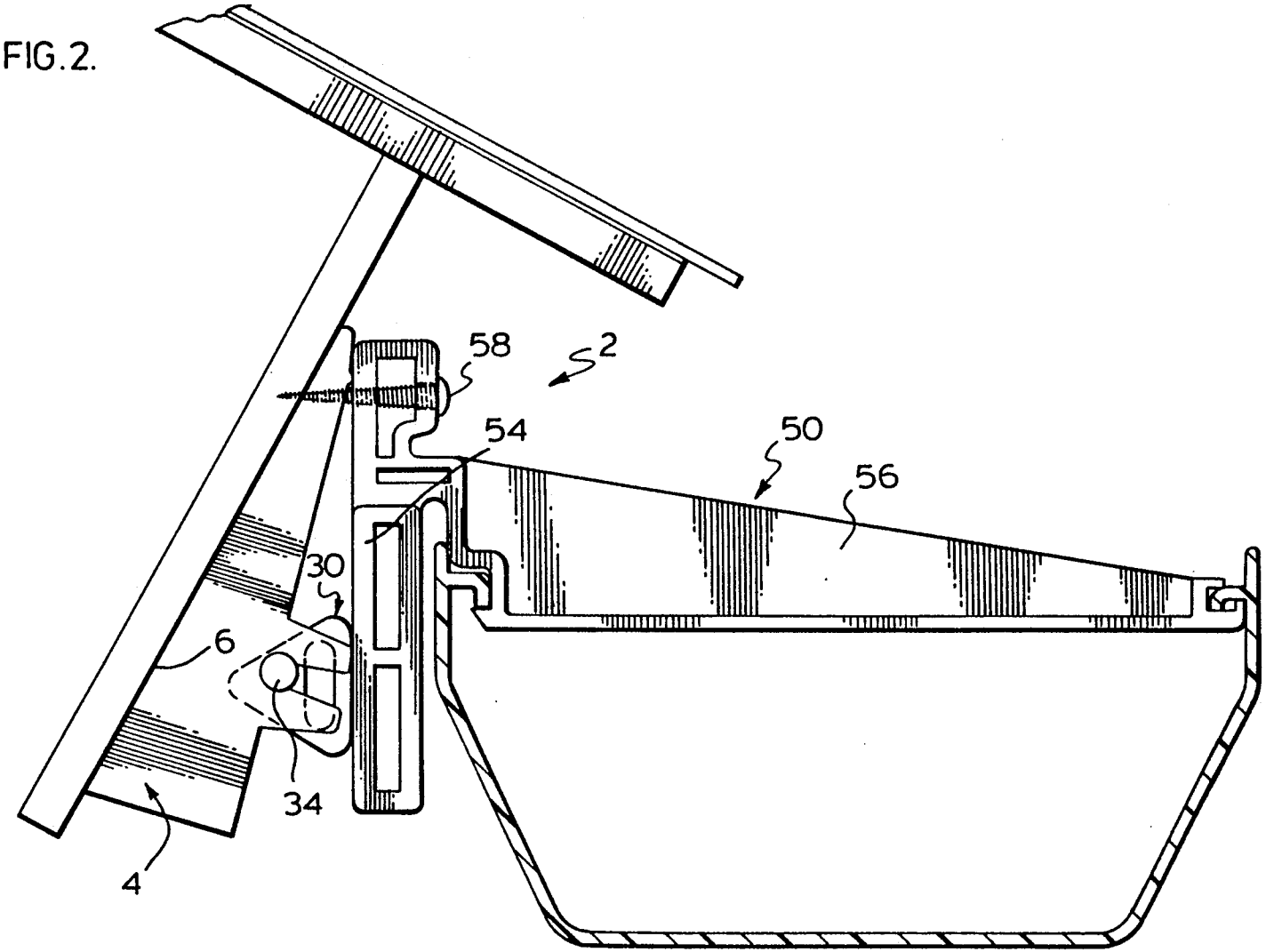
FIG. 2 is a side elevation of the fascia angle adapter and hanger mounted on an angled fascia board.
Figure 3:
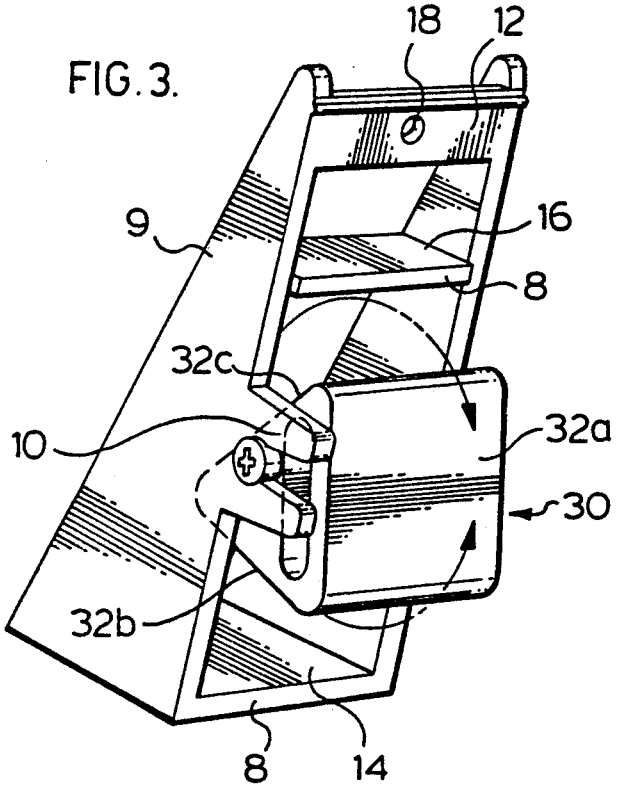
FIG. 3 is a perspective view of the fascia angle adapter.
Figure 4:
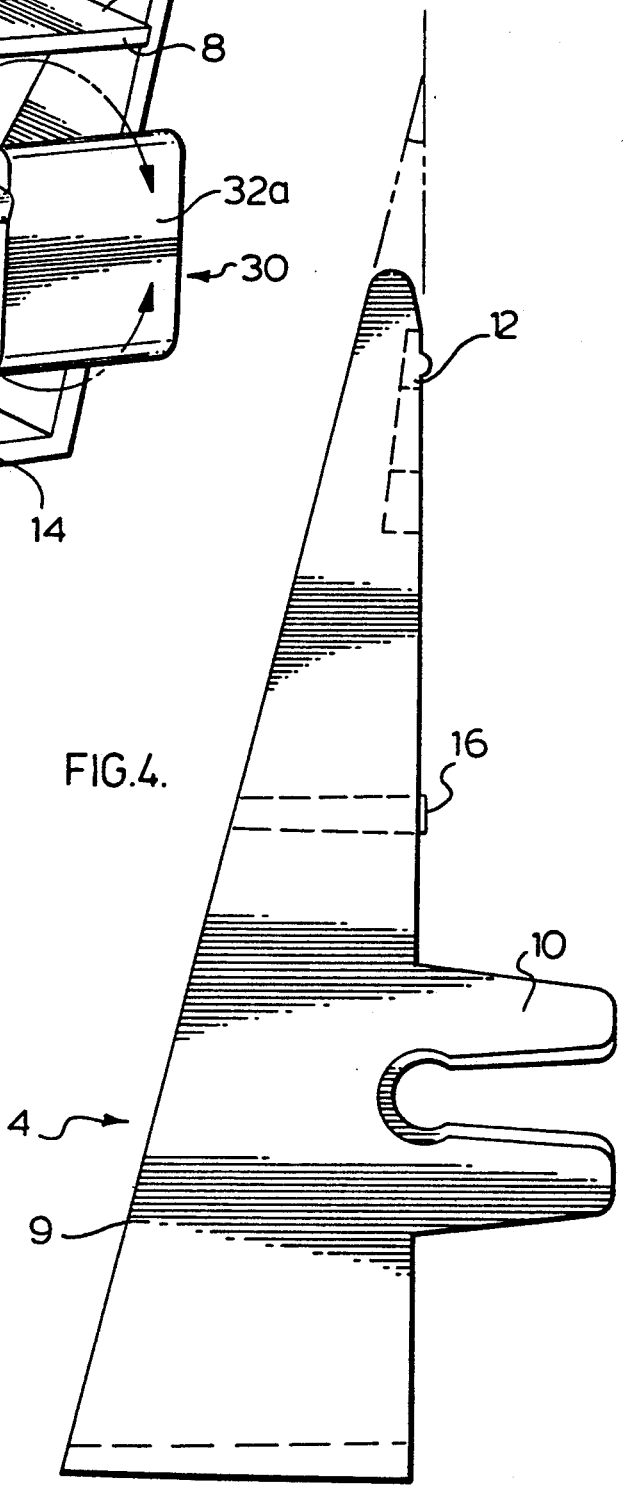
FIG. 4 is a side elevation of the base member of the fascia angle adapter.

The fascia angle adapter is shown mounted on a fascia board in FIG. 2 and is supporting the eavestrough hanger 50. As can be seen, the mounting port 52 of the eavestrough hanger and the top mounting port 18 of the fascia angle adapter are aligned and a common screw 58 is used for securing of the two components to the fascia board. The cam member has been appropriately adjusted such that the eavestrough hanger 50 extends generally horizontally, as measured by the cantilevered arm 56 such that the eavestrough is generally horizontal. Thus, the full capacity of the eavestrough can be realized.

Figures 5, 6, 7:
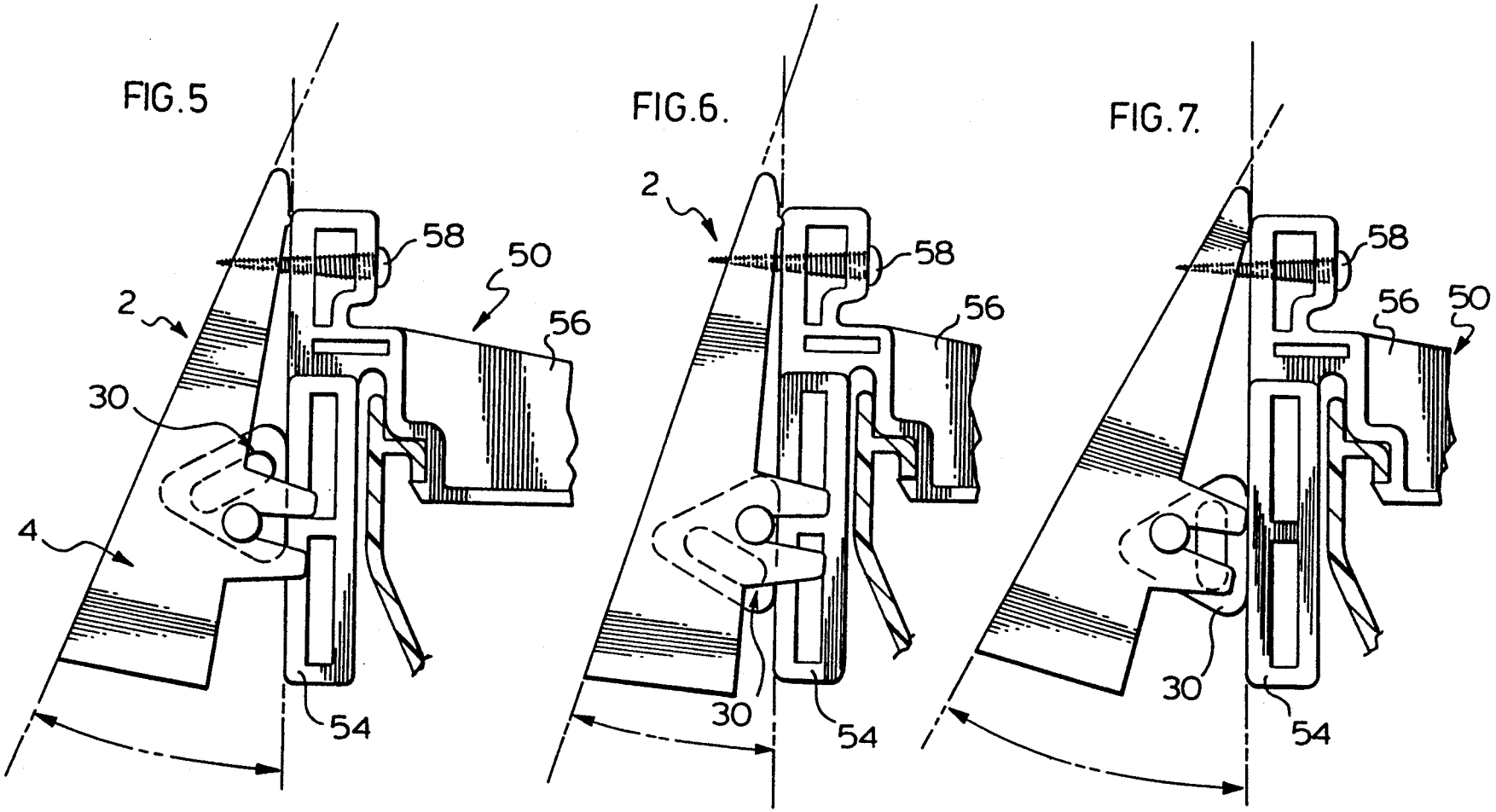
FIGS. 5 through 7 are side elevations showing the fascia angle adapter on angled fascia boards associated with predetermined roof slopes.

FIGS. 5 through 6 show various positions of the cam supporting the eavestrough hanger for different roof slopes. There are basically four common roof slopes and the fascia angle adapter has been configured such that without the cam, the shallowest slope, a 3/12, is satisfied and the cam and base member accommodate the other three angles, namely, a 4/12, a 5/12 and a 6/12.

As can be seen from the above, the fascia angle adapter provides a simple solution for satisfying the common corrections required for roof slopes of 3/12, 4/12, 5/12 and 6/12 where the fascia board is generally perpendicular thereto. It can further be appreciated that, if necessary, other cam members can be provided or the cam member can be modified to have additional faces to position the eavestrough hanger 50 or other support fitting at different angles.

The cam 50 is basically forced into the bearings provided at the base of the bifurcated arms 10 and is maintained therein by means of a generally tight fit with the cam pins. The cam does not move from the desired position, as it is engaging the flat surface of the support member 54 of the eavestrough hanger or other eavestrough support fitting and the gravity exerted on the hanger, due to its own weight and the weight of the eavestrough, maintains the cam in this adjusted position. Eavestrough hangers are the most commonly used fittings used to support the eavestrough, however the fascia angle adapter is used in combination with joiners and other fittings adapted to provide a support connection with the fascia.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A fascia angle adapter for an eavestrough system comprising a base member having a fascia engaging surface and a second surface opposite said fascia engaging surface adapted to support a mounting base of an eavestrough hanger, said fascia engaging surface and said second surface being angled to define a shallow wedge, said component further including an eccentric cam rotatably supported by said base member and projecting forwardly of said second surface, said cam being rotatable within said base member to various positions to define a support surface for an eavestrough hanger.

2. A fascia angle adapter for an eavestrough system comprising a base member having a fascia engaging surface, a top port for securing of said adapter to a fascia board, and an eccentric cam supported by said base member and movable with respect thereto whereby the cam can be moved to various positions such that the exterior surface of said cam is spaced a different distance from said fascia engaging surface.

3. A fascia angle adapter as claimed in claim 2 wherein said cam has at least three planar surfaces about the periphery of said cam for defining in cooperation with said base member predetermined angles for known angled fascia.

4. A fascia angle adapter as claimed in claim 2 wherein said cam has pins either side thereof which are received in support arms of said base whereby said cam is rotatable within said base.

5. A fascia angle adapter as claimed in claim 4 wherein said base has two side sections interconnected at the top thereof by a bridging member having therein said top port for securing of said adapter to a fascia board, said side sections being interconnected at the bottom thereof by a bottom member.

6. A fascia angle adapter as claimed in claim 4 wherein said base member is generally closed on the sides and closed on the top and bottom to define a framework having a wedge-like shape, said framework further including an intermediate reinforcing strut extending between said side sections.

7. A fascia angle adapter as claimed in claim 6 wherein said cam is located below the center plane of said framework.

8. A fascia angle adapter as claimed in claim 7 wherein said support arms of said base are located on said side sections and each arm includes a bifurcated section for retaining of said pins of said cam.

9. A fascia angle adapter as claimed in claim 8 wherein said cam has at least three separate lobes each of which is a planar face for supporting a eavestrough hook.

10. A fascia angle adapter as claimed in claim 9 wherein said each planar face of said cam is a different perpendicular distance from said pins which in cooperation with said base define a different angle for supporting of an eavestrough hook necessary for different roof slopes where the fascia is perpendicular to the slope of the roof.

11. A fascia angle adapter as claimed in claim 10 wherein said cam has three lobes and is generally triangular.

12. A fascia angle adapter as claimed in claim 11 wherein said reinforcing strut has a front surface for engaging an eavestrough fitting when properly received within said adapter.

13. In combination an eavestrough hook, a fascia angle adapter, and a facia, said fascia angle adapter and said eavestrough hook each having a similar mounting port through which a common fastening member extends effecting common securement of said facia angle adapter and said eavestrough hook to a facia, said fascia angle adapter including a displaceable member intermediate said eavestrough hook and said adapter, said displaceable. member being received in said adapter in varying orientations defining varying widths of said displaceable member whereby said displaceable member is orientated in said adapter to determine the angle of said eavestrough hook relative to said adapter when aligned therewith in an operative position and said mounting ports are aligned, said displaceable member being movable to various positions altering the spacing between said eavestrough hook and said adapter in accordance with the width of said displaceable member whereby the angle of said eavestrough hook relative to said adapter is varied.

14. In combination as claimed in claim 13 wherein said displaceable member is removable from said adapter whereby said adapter and eavestrough hook define a further angle of said eavestrough fitting relative to said adapter.

15. In combination as claimed in claim 14 wherein said displaceable member is a cam having different faces thereon for appropriately positioning said eavestrough fitting.

16. In combination as claimed in claim 15 wherein said cam is rotatably supported by said adapter.

17. In combination as claimed in claim 16 wherein said adapter has a base, said base comprising two side portions interconnected at the top thereof by a bridging member having therein a top port for securing of said adapter to a fascia board, said side portions being interconnected at the bottom thereof by a bottom member.

18. In combination as claimed in claim 17 wherein said base member is generally closed on the sides and closed on the top and bottom to define a framework having a wedge-like shape, said framework further including an intermediate reinforcing strut extending between said side sections.

19. In combination as claimed in claim 18 wherein said cam has at least three separate lobes each of which is a planar face for supporting said eavestrough hook.

20. In combination as claimed in claim 19 wherein said cam lobes accommodate roof slopes of 4/12, 5/12, and 6/12 where the fascia board is generally perpendicular to said roof.

* * * * *